US007839418B2

(12) United States Patent
Kwon

(10) Patent No.: US 7,839,418 B2
(45) Date of Patent: Nov. 23, 2010

(54) APPARATUS AND METHOD FOR DRIVING LIQUID CRYSTAL DISPLAY DEVICE

(75) Inventor: Kyung Joon Kwon, Seoul (KR)

(73) Assignee: LG Display Co., Ltd., Seoul (KR)

( * ) Notice: Subject to any disclaimer, the term of this patent is extended or adjusted under 35 U.S.C. 154(b) by 1184 days.

(21) Appl. No.: 11/475,051

(22) Filed: Jun. 27, 2006

(65) Prior Publication Data

US 2007/0139326 A1 Jun. 21, 2007

(30) Foreign Application Priority Data

Dec. 20, 2005 (KR) ..... 10-2005-0126274

(51) Int. Cl.
*G09G 5/02* (2006.01)

(52) U.S. Cl. ..... 345/604; 345/83; 345/88; 345/89; 345/589; 345/690

(58) Field of Classification Search ..... 358/3.27; 348/650; 382/254; 345/589, 87–103, 604, 345/690

See application file for complete search history.

(56) References Cited

U.S. PATENT DOCUMENTS

| | | | | |
|---|---|---|---|---|
| 7,505,026 | B2 * | 3/2009 | Baba et al. | 345/102 |
| 7,646,512 | B2 * | 1/2010 | Hsieh et al. | 358/3.01 |
| 2003/0031366 | A1 * | 2/2003 | Li et al. | 382/206 |
| 2004/0207589 | A1 * | 10/2004 | Kim et al. | 345/89 |
| 2004/0222999 | A1 * | 11/2004 | Choi et al. | 345/589 |
| 2005/0063603 | A1 * | 3/2005 | Wang et al. | 382/254 |
| 2005/0149288 | A1 * | 7/2005 | Wilt | 702/180 |
| 2006/0146351 | A1 * | 7/2006 | Lo et al. | 358/1.9 |
| 2006/0181741 | A1 * | 8/2006 | Hsu et al. | 358/3.27 |
| 2006/0274212 | A1 * | 12/2006 | Lo et al. | 348/650 |
| 2008/0297448 | A1 * | 12/2008 | Mizukoshi et al. | 345/76 |

FOREIGN PATENT DOCUMENTS

| | | |
|---|---|---|
| JP | 02-205984 | 8/1990 |
| JP | 2003-230160 | 8/2003 |
| JP | 2004-286814 | 10/2004 |
| JP | 2004-295086 | 10/2004 |
| JP | 2005-196184 | 7/2005 |
| JP | 2005-286611 | 10/2005 |
| JP | 2006-317899 | 11/2006 |

* cited by examiner

*Primary Examiner*—Xiao M Wu
*Assistant Examiner*—Phi Hoang
(74) *Attorney, Agent, or Firm*—McKenna Long & Aldridge LLP

(57) ABSTRACT

An apparatus and method for driving a liquid crystal display minimizes a gray loss of an image displayed on an RGBW-type display device, and enhances brightness and image quality. The apparatus for driving the LCD device includes: a liquid crystal panel including a plurality of unit pixels composed of 4-color sub-pixels; a data driver to transmit a video data signal to individual sub-pixels; a gate driver to transmit a scan pulse to the sub-pixels; a data converter to generate a histogram using a gray difference of input 3-color source data, to convert the 3-color source data into 4-color data according to a gain value extracted from the histogram, and to output the 4-color data; and a timing controller to transmit the 4-color data received from the data converter to the data driver and to control the gate driver and the data driver.

19 Claims, 6 Drawing Sheets

APPARATUS AND METHOD FOR DRIVING LIQUID CRYSTAL DISPLAY DEVICE

This application claims the benefit of Korean Patent Application No. 2005-126274, filed on Dec. 20, 2005, which is hereby incorporated by reference for all purposes as if fully set forth herein.

BACKGROUND OF THE INVENTION

1. Field of the Invention

The present invention relates to a liquid crystal display (LCD) device, and more particularly to an apparatus and method for driving a liquid crystal display that minimizes a gray loss of an image displayed on an RGBW-type display device.

2. Discussion of the Related Art

A variety of flat panel display devices smaller and lighter in weight than typical Cathode Ray Tube (CRT) display devices have been developed. For example, display devices such as a liquid crystal display (LCD), a Field Emission Display (FED), a Plasma Display Panel (PDP), and a Light Emitting Display (LED) have been widely used as flat panel display devices.

A typical LCD device includes a plurality of liquid crystal cells arranged in regions defined by the crossings of a plurality of data lines and a plurality of gate lines. Each liquid crystal cell includes a Thin Film Transistor (TFT) substrate and a color-filter substrate, and further includes a liquid crystal layer formed between the TFT substrate and the color-filter substrate.

The TFT substrate on which TFTs serving as switch elements are formed and the color-filter substrate on which color filters are formed are spaced apart from each other by a predetermined distance.

The LCD device generates an electric field in each pixel of a liquid crystal cell according to data signals applied to the data lines. The electric field controls the transmissivity of light through the liquid crystal layer in each liquid crystal cells to produce images. To prevent degradation that occurs to the liquid crystal device when an electric field is applied to the liquid crystal in a particular direction for too long a period, the polarity of a data signal is reversed for each frame, column, or dot.

The LCD device generates an image by mixing red, green, and blue lights provided by 3-color pixels of red (R), green (G), and blue (B). However, the light efficiency of a typical LCD device for displaying one sub-pixel using 3-color dots of red (R), green (G), and blue (B) is relatively low. More specifically, since a color filter arranged in each sub-pixel of red (R), green (G), and blue (B) allows about ⅓ of incident light to penetrate the filter, light efficiency is significantly reduced.

Korean Patent publication No. P2002-13830 ("LCD Device") and Korean Patent publication No. P2004-83786 ("Apparatus for Driving of Display Device and Method for Driving Thereof") disclose an RGBW type LCD device, which includes a white color filter W in additional to the red, green, and blue color filters for maintaining the color realization ratio and to improving light efficiency in an LCD device. The above-described RGBW type LCD device converts a 3-color image signal into a 4-color image signal, thereby increasing brightness of a color image.

FIG. 1 illustrates a view of a color area to be embodied in an RGBW type display device according to the related art. FIG. 1 shows Gamut plane coordinates with red (R) and green (G) axes displayed in three-dimensional orthogonal coordinates with red (R), green (G) and blue (B) axes. A square area indicated by solid lines represents colors to be displayed by a 3-color image signal, and a hexahedron area indicated by thick solid lines represents colors to be displayed by a 4-color image signal. That is, the RGBW type liquid crystal display device extends a color area in a diagonal direction as indicated by the dotted lines by adding white (W) to a 3-color of red (R), green (G), and blue (B). As a result, in a process for converting a 3-color image signal into a 4-color image signal, each coordinate in the square is extended into coordinates in the hexahedron.

In the RGBW type LCD device, an apparatus for converting a 3-color image signal into a 4-color image signal has various gain curve characteristics G1, G2, G3, and G4. Even though the gain curves G1, G2, G3, and G4 vary, brightness amplification factors in the gain curves G1, G2, G3, and G4 with respect to white (W) are the same. However, each 3-color image signal (A) with respect red (R), green (G), and blue (B) colors has a different amplification factor, such as A', A", and A'". Accordingly, the brightness amplification factors of white (W) and any 3-color image signal (A) in any one of the gain curves are different from each other.

For example, when an image in which pure color with a gain value of "1" and tone color with a gain value of "2" are mixed, the brightness amplification factors are considerably different. Because the brightness amplification factors according to an inputted 3-color image signal in the RGBW type LCD device are different from each other, an image from the RGBW type LCD device is perceived differently from an image of an RGB type liquid crystal display device.

In addition, in the RGBW-type LCD device of the related art a high gain value may result in a gray overflow in some pixels resulting in color-image distortion caused by gray loss.

SUMMARY OF THE INVENTION

Accordingly, the present invention is directed to an apparatus and method for driving a liquid crystal display (LCD) device that substantially obviate one or more problems due to limitations and disadvantages of the related art.

An advantage of the present invention is to provide an apparatus and method for driving an LCD device that minimizes gray loss of an image displayed on an RGBW-type display device and enhances brightness and image quality.

Additional features and advantages of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, an apparatus for driving a liquid crystal display (LCD) device includes: a liquid crystal panel including a plurality of unit pixels composed of 4-color sub-pixels; a data driver to transmit a video data signal to individual sub-pixels; a gate driver to transmit a scan pulse to the sub-pixels; a data converter to generate a histogram using a gray difference of input 3-color source data, to convert the 3-color source data into 4-color data according to a gain value extracted from the histogram, and to output the 4-color data; and a timing controller to transmit the 4-color data received from the data converter to the data driver and to control the gate driver and the data driver.

In another aspect of the present invention a method for driving a liquid crystal panel equipped with a plurality of unit pixels composed of 4-color sub-pixels includes: generating histogram from input 3-color source data, and extracting a gain value from the histogram; converting the 3-color source data into 4-color data according to the gain value; and converting the 4-color data into video data, and transmitting the video data to the unit pixels.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings.

DETAILED DESCRIPTION OF THE ILLUSTRATED EMBODIMENTS

Reference will now be made in detail to the embodiments of the present invention, examples of which are illustrated in the accompanying drawings. Wherever possible, the same reference numbers will be used throughout the drawings to refer to the same or like parts.

Figure 1:
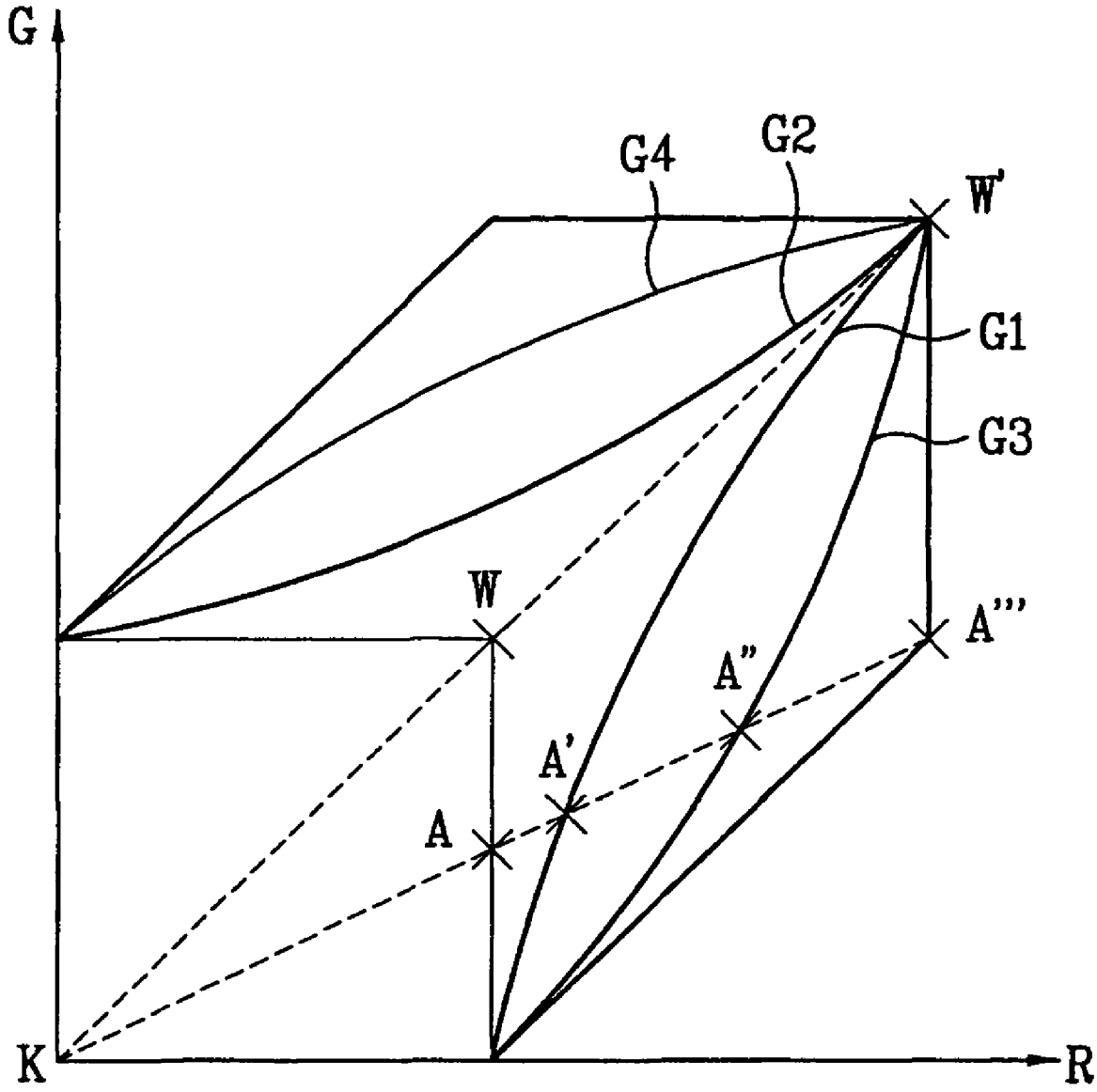
FIG. 1 shows a color area capable of being implemented on an RGBW-type display device.
Figure 2:
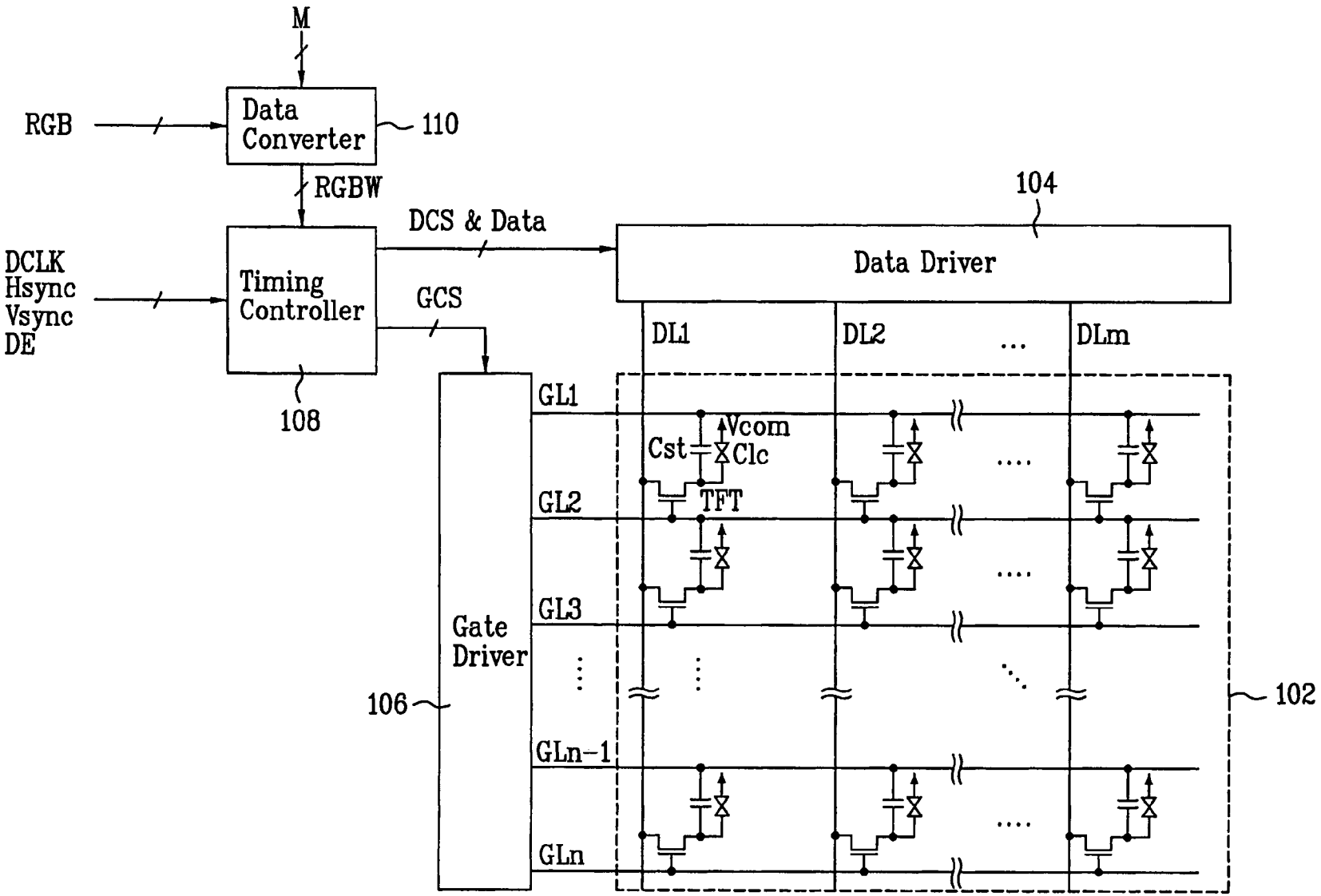
FIG. 2 is a block diagram, illustrating an apparatus for driving an LCD device according to an embodiment of the present invention.

FIG. 2 is a block diagram illustrating an apparatus for driving an LCD device according to an embodiment of the present invention.

Referring to FIG. 2, an apparatus for driving the LCD device according to an embodiment the present invention includes a liquid crystal panel 102, a data driver 104, a gate driver 106, a data converter 110, and a timing controller 108. The liquid crystal panel 102 includes a liquid crystal cell formed at each 4-color sub-pixel area defined by N gate lines (GL1 to GLn) and M data lines (DL1 to DLm). The data driver 104 transmits a video data signal to the data lines (DL1 to DLm). The gate driver 106 transmits a scan pulse to the gate lines (GL1 to GLn). The data converter 110 creates a histogram using a gray difference of input 3-color source data (RGB), and converts the 3-color source data (RGB) to 4-color data (RGBW) according to a gain value extracted from the created histogram. The timing controller 108 arranges the 4-color data (RGBW) received from the data converter 110, transmits the 4-color data (RGBW) to the data driver 104, creates a data control signal (DCS) to control the data driver 104, and outputs a gate control signal (GCS) to the gate driver 106.

The liquid crystal panel 102 includes a plurality of TFTs and a plurality of liquid crystal cells with each cell connected to a TFT. The TFTs are formed in areas defined by crossings of N gate lines (GL1 to GLn) and M data lines (DL1 to DLm).

Each TFT responds to a scan pulse received from the gate lines (GL1 to GLn), by transmitting a data signal received from the data lines (DL1 to DLm) to a liquid crystal cell. Each liquid crystal cell includes common electrodes arranged substantially parallel to each other; a liquid crystal between the common electrodes; and a sub-pixel electrode connected to a TFT. The liquid crystal cell may be represented by an equivalent circuit including a liquid crystal capacitor Clc. The liquid crystal cell also includes a storage capacitor (Cst) to maintain the data signal charged in the liquid crystal capacitor Clc until the next data signal is charged in the liquid crystal capacitor Clc.

Red (R), green (G), blue (B), and white (W) sub-pixels (i.e., RGBW sub-pixels) are repeatedly formed in a row direction of the sub-pixels. A color filter corresponding to each color (R, G, and B) is arranged at each RGB sub-pixel. However, a color filter is not additionally arranged at the W sub-pixels.

The RGBW sub-pixels have a stripe structure of the same or different area ratios. The RGBW sub-pixels may be arranged in the form of a 2×2 matrix.

The data converter 110 generates a histogram for each gray difference using a gray difference of RGB source data applied to each unit pixel composed of red (R), green (G) and blue (B) sub-pixels. The data converter 110 converts the RGB source data to RGBW data according to a gain value extracted from the histogram for each gray difference, and transmits the RGBW data to the timing controller 108.

The timing controller 108 arranges the RGBW data received from the data converter 110 according to the operation of the liquid crystal panel 102, and provides the data driver 104 with the RGBW data. The timing controller 108 creates a data control signal (DCS) and a gate control signal (GCS) using a main clock signal (MCLK), a data enable signal (DE), and horizontal and vertical synchronous signals (Hsync and Vsync), and controls individual drive timings of the data driver 104 and the gate driver 106 using the DCS and GCS control signals.

The gate driver 106 includes a shift register. The shift register responds to a gate start pulse (GSP) and a gate shift clock (GSC) contained in the gate control signal (GCS) received from the timing controller 108, and sequentially generates scan pulses (i.e., gate high pulses). The TFTs are switched on by the scan pulses.

The data driver 104 converts the RGBW data arranged by the timing controller 108 into an analog video data signal upon receiving the data control signal (DCS) from the timing controller 108, and transmits the analog video data signal of a horizontal line for each horizontal period, during which period the scan pulse is applied to the gate lines (GL1 to GLn), to the data lines (DL1 to DLm).

In other words, the data driver 104 selects a gamma voltage having a predetermined level according to a gray value of RGBW data, and provides the data lines (DL1 to DLm) with the selected gamma voltage.

Figure 3:
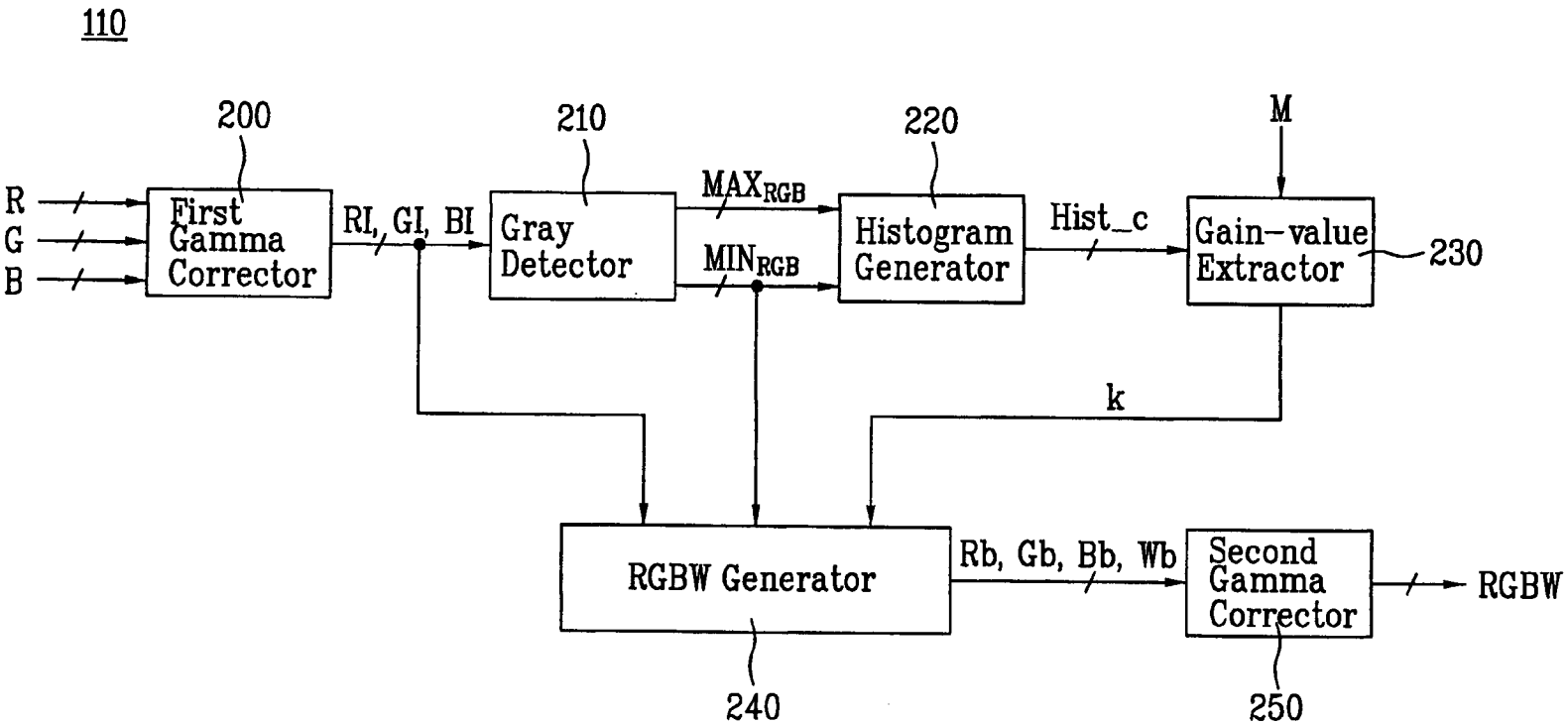
FIG. 3 is a block diagram illustrating a data converter for the LCD device shown in FIG. 2.

FIG. 3 is a block diagram illustrating a data converter shown in FIG. 2 according to an embodiment of the present invention.

Referring to FIGS. 2 and 3, the data converter 110 includes a first gamma corrector 200, a gray detector 210, a histogram generator 220, a gain value extractor 230, an RGBW generator 240, and a second gamma corrector 250.

The first gamma corrector 200 generates linearized 3-color data (RI, GI, and BI),using the following equation 1, because the 3-color source data (RGB) of each unit pixel of an input image has been gamma-corrected corresponding to the of output characteristics of the CRT.

$$RI=R^{\gamma}$$

$$GI=G^{\gamma}$$

$$BI=B^{\gamma} \quad \text{(Equation 1).}$$

The gray detector 210 compares primary 3-color data (RI, GI, and BI) received from the first gamma corrector 200, and detects a maximum gray value ($MAX_{RGB}$) and a minimum gray value ($MIN_{RGB}$).

The gray detector 210 transmits the maximum gray value ($MAX_{RGB}$) and the minimum gray value ($MIN_{RGB}$) to the histogram generator 220 and additionally transmits the minimum gray value ($MIN_{RGB}$) to the RGBW generator 240.

Figure 4:
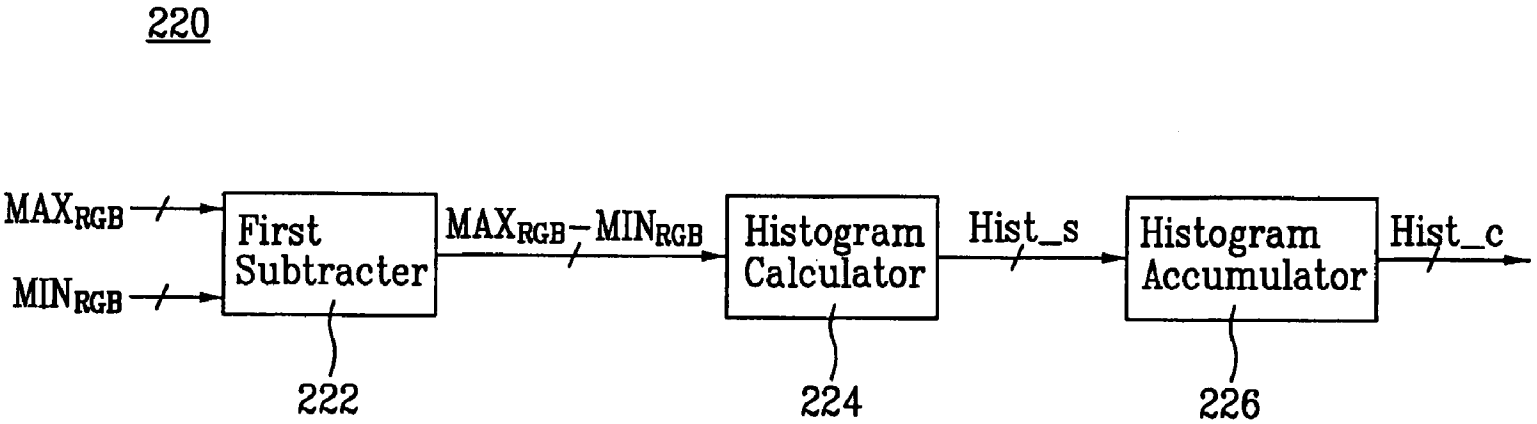
FIG. 4 is a block diagram illustrating a histogram generator of the data converter shown in FIG. 3.

FIG. 4 is a block diagram illustrating the histogram generator shown in FIG. 3. As shown in FIG. 4, the histogram generator 220 includes a first subtracter 222, a histogram calculator 224, and a histogram accumulator 226.

The first subtracter 222 subtracts the minimum gray value ($MIN_{RGB}$) from the maximum gray value ($MAX_{RGB}$) for each unit pixel received from the gray detector 210 and acquires a gray difference ($MAX_{RGB}-MIN_{RGB}$) for each unit pixel.

The gray difference ($MAX_{RGB}-MIN_{RGB}$) for each unit pixel determines gray saturation of the corresponding pixel when 3-color source data (i.e., RGB data) is converted into 4-color data (i.e., RGBW data).

The histogram calculator 224 counts the number of pixels for each gray difference ($MAX_{RGB}-MIN_{RGB}$) of each unit pixel received from the first subtracter 222 and calculates a histogram (Hist_s) for each gray difference.

The histogram accumulator 226 receives the histogram (Hist_s) for each gray difference from the histogram calculator 224, accumulates the received histogram (Hist_s) according to individual gray differences, and transmits the accumulated histogram (Hist_c) for each gray difference to the gain-value extractor 230.

The gain-value extractor 230 shown in FIG. 3 receives the accumulated histogram (Hist_c) for each gray difference from the histogram accumulator 226 and calculates a gray loss limit value (N) of the accumulated histogram for each gray difference at a specific time at which the accumulated histogram (Hist_c) is higher than the gray setup value M and extracts a gain value (k) using the following equation 2. The gray setup value M may be provided through user input. The gain-value extractor 220 transmits the extracted gain value (k) to the RGBW generator 240.

$$k = \frac{MAX_{Gray}}{N+1} \quad \text{(Equation 2).}$$

In Equation 2, $MAX_{Gray}$ is indicative of a maximum gray value corresponding to the number of bits of RGB source data. For example, if the RGB source data is composed of 8 bits, the value of $MAX_{Gray}$ is "255". The value 1 is added to the gray limit value (N) to prevent the denominator from being zero in Equation 2.

The gray saturation setup value (M) established by the user is indicative of a variable capable of establishing the number of gray-saturation-allowed pixels displayed on the liquid crystal panel 102. The gray saturation setup value M may be set to "0", "3000", "6000", and "10000", etc., according to a user's preferences depending on resolution of the liquid crystal panel 102.

The gray saturation setup value M is indicative of the number of pixels in which the gray saturation can occur during the creation of the RGBW data without a perceptible effect on image quality For example, provided that a gray saturation setup value (M) is set to "10000" and the value $MAX_{RGB}-MIN_{RGB}$ of a specific time at which the accumulated value of the histogram (Hist_s) for each gray difference exceeds the value of "10000", is set to "135", the gain-value extractor 230 sets a specific number "135" to a gray loss limit value (N), adds the value of 1 to the gray loss limit value (N), and divides "255" by "136", resulting in a gain value (k) of 1.875 to be transmitted to the RGBW generator 240.

Figure 5:
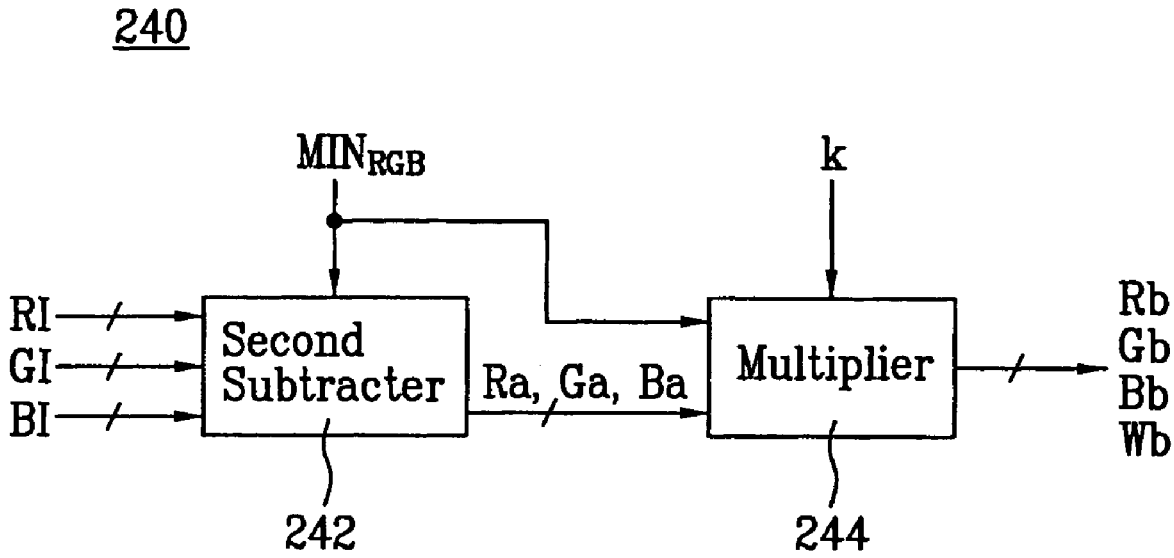
FIG. 5 is a block diagram illustrating an RGBW generator shown in FIG. 3 according to an embodiment of the present invention.

The RGBW generator 240 includes a second subtracter 242 and a multiplier 244 as shown in FIG. 5. FIG. 5 is a block diagram illustrating the RGBW generator shown in FIG. 3 according to an embodiment of the present invention.

The second subtracter 242 generates secondary 3-color data (Ra, Ga, and Ba) using the primary 3-color data (RI, GI, and BI) received from the first gamma corrector 200 and the minimum gray value ($MIN_{RGB}$) received from the gray detector 210, as denoted by the following equation 3:

$$Ra=RI-MIN_{RGB}$$

$$Ga=GI-MIN_{RGB}$$

$$Ba=BI-MIN_{RGB} \quad \text{(Equation 3).}$$

In other words, the second subtracter 242 subtracts the minimum gray value ($MIN_{RGB}$) from each primary 3-color data (RI, GI, and BI) to generate secondary 3-color data (Ra, Ga, and Ba).

The multiplier 244 receives the secondary 3-color data (Ra, Ga, and Ba) from the secondary subtracter 242, and receives the gain value (k) from the gain-value extractor 230 and generates 4-color conversion data (Rb, Gb, Bb, and Wb) according to the following equation 4:

$$Rb=Ra\times k$$

$$Gb=Ga\times k$$

$$Bb=Ba\times k$$

$$Wb=MIN_{RGB}\times k \quad \text{(Equation 4).}$$

In other words, the multiplier 244 multiplies each secondary 3-color data (Ra, Ga, and Ba) by the gain value (k) to generate three-color conversion data (Rb, Gb, and Bb). The multiplier 244 multiplies the minimum gray value ($MIN_{RGB}$) by the gain value (k), to generate white conversion data (Wb). The 4-color conversion data (Rb, Gb, Bb, and Wb) is applied to the second gamma corrector 250.

The three-color conversion data (Rb, Gb, and Bb) created by the multiplier 244 is amplified by the gain value (k) generated from the accumulated histogram (Hist_) for each gray difference according to the gray saturation value (M) established by the user. Most of the 3-color conversion data (Rb, Gb, and Bb) is amplified to be equal to or less than a maximum gray number (e.g., "255" in the case of 8-bits) corresponding to the number of bits of input data (RGB), such that the gray loss caused by the gain amplification is minimized.

The second gamma corrector 250 receives 4-color conversion data (Rb, Gb, Bb, and Wb) from the RGBW generator 240, and performs gamma-correction on the received 4-color conversion data (Rb, Gb, Bb, and Wb) according to the following equation 5 to create 4-color data (RGBW).

$$R=(Rb)^{1/\gamma}$$

$$G=(Gb)^{1/\gamma}$$

$$B=(Bb)^{1/\gamma}$$

$$W=(Wb)^{1/\gamma} \quad \text{(Equation 5).}$$

The second gamma corrector 250 performs gamma-correction of the 4-color conversion data (Rb, Gb, Bb, and Wb) using 4-color data (RGBW) suitable for a drive circuit of the liquid crystal panel 102 by from a look-up table and transmits the gamma-corrected result to the timing controller 108.

A process for converting 3-color data (i.e., RGB data) into 4-color data (i.e., RGBW data) using the data converter 110 according to an embodiment present invention will hereinafter be described.

Figure 6A:
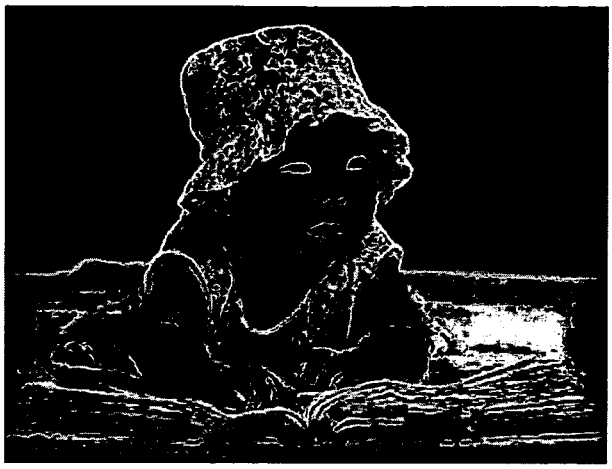
FIGS. 6A, 6B, and 6C show a process for converting 3-color data into 4-color data using the data converter according to an embodiment of the present invention.

The data converter 110 performs gamma-correction of the 3-color source data (i.e., RGB data) corresponding to individual unit pixels of an input image shown in FIG. 6A to generate the linearized result of the primary 3-color data (RI, GI, and BI). The data converter 110 detects the maximum gray value ($MAX_{RGB}$) and the minimum gray value ($MIN_{RGB}$) of the linearized primary 3-color data (RI, GI, and BI) of each unit pixel.

Figure 6B:
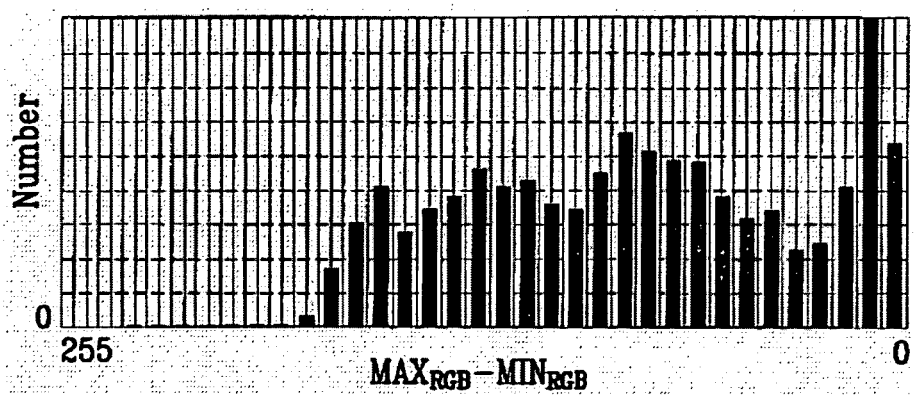

The data converter 110 counts the number of pixels for each gray difference shown in FIG. 6B using the gray difference ($MAX_{RGB}-MIN_{RGB}$) to acquire the histogram (Hist_) for each gray difference.

Figure 6C:
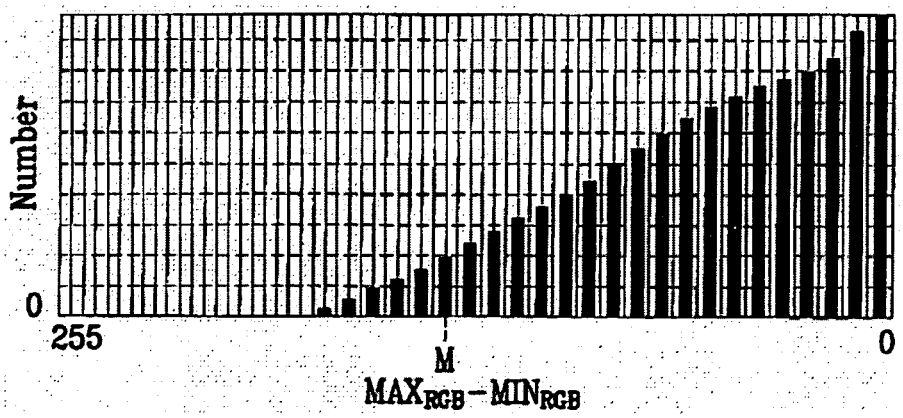

The data converter 110 accumulates the histogram (Hist_) according to individual gray differences to generate the accumulated histogram (Hist_) for each gray difference as shown in FIG. 6C.

The data converter 110 receives the accumulated histogram stage N for each gray difference at a specific time at which the accumulated histogram (Hist_) for each gray difference exceeds the gray saturation setup value M entered by the user, and calculates the gain value (k) according to the aforementioned Equation 2 using the received histogram stage N.

The data converter 110 generates 4-color conversion data (Rb, Gb, Bb, and Wb) according to the aforementioned equations 3 and 4 on the basis of the primary 3-color data (RI, GI, and BI) and the minimum gray value ($MIN_{RGB}$) and performs gamma-correction on the 4-color conversion data (Rb, Gb, Bb, and Wb) to generate final 4-color data (i.e., RGBW data).

The apparatus and method for driving the LCD device according to an embodiment of the present invention can recognize which of the pixels will incur gray saturation on the basis of the gray saturation setup value (M) established by the user allowing gray saturation is controlled to be less than a predetermined level visually unrecognizable by the user, and at the same time brightness of the liquid crystal panel 102 equipped with RGBW sub-pixels can be maintained at a high level.

In other words, as it is difficult for the user to visually discern gray saturation in a small area of the image displayed on the liquid crystal panel 102, the gain value (k) may be set to a high gain value resulting in a display having increased brightness and image-quality with only a slight gray loss.

For example, if the gray setup value M is set to "10000", 10000 pixels of the pixels contained in the liquid crystal panel 102 of 1366×768 resolution correspond to an area of only 0.95% of the total liquid crystal panel 102 area. Gray saturation in the 10000 pixels does not appreciably degrade image quality.

As apparent from the above description, the apparatus and method for driving the LCD device according to an embodiment of the present invention extracts a gain value using a histogram analyzed on the basis of a difference between the maximum gray value and the minimum gray value of input data, such that gray loss occurs to be less than a gray saturation setup value established by the user. In addition, the apparatus and method for driving the LCD device converts 3-color data into 4-color data.

Therefore, the present invention can guarantee a maximum brightness while simultaneously minimizing the gray loss, and can more naturally display a desired image on an RGBW-type liquid crystal panel due to the increased brightness and the minimized gray loss.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method for driving a liquid crystal panel equipped with a plurality of unit pixels composed of 4-color sub-pixels comprising:

generating a histogram from input 3-color source data, and extracting a gain value from the histogram;

converting the 3-color source data into 4-color data according to the gain value; and converting the 4-color data into video data, and transmitting the video data to the unit pixels, wherein generating the histogram using a gray difference of input 3-color source data includes performing gamma-correction on the 3-color source data to generate linearized primary 3-color data, detecting maximum and minimum gray values for each unit pixel of the linearized primary 3-color data, and generating the histogram using a difference between the maximum and minimum gray values, wherein generating the histogram using a difference between the maximum and minimum gray values includes subtracting the minimum gray value from the maximum gray value, and generating the difference between the maximum and minimum gray values, counting the number of the unit pixels corresponding to the difference between the maximum and minimum gray values, and calculating histogram for each gray difference.

2. The method according to claim 1, wherein extracting the gain value includes extracting the gain value corresponding to the histogram and a gray saturation setup value established by a user.

3. The method according to claim 2, wherein the gray saturation setup value is indicative of the number of pixels incurring the gray saturation from among the plurality of unit pixels.

4. The method according to claim 2, wherein generating the histogram using a gray difference of input 3-color source data includes extracting the gain value using the histogram and the gray saturation setup value.

5. The method according to claim 4, wherein generating the histogram using a difference between the maximum and minimum gray values includes:

accumulating the histogram for each gray difference and calculating the accumulated histogram for each gray difference.

6. The method according to claim 5, wherein accumulating the histogram includes:

performing the accumulation in the direction from a first histogram having a maximum gray difference to a second histogram having a minimum gray difference.

7. The method according to claim 5, wherein extracting the gain value using the histogram and the gray saturation setup value includes:

recognizing a gray loss limit value indicating a specific time at which the accumulated histogram for each gray difference exceeds the gray saturation setup value;

recognizing a total number of grays corresponding to the number of bits of the source data; and generating the gain value using the recognized gray loss limit value and the recognized gray number.

8. The method according to claim 7, wherein generating the gain value using the recognized gray loss limit value and the recognized gray number includes:

calculating an added resultant value by adding 1 to the gray loss limit value; and dividing the total number of grays by the added resultant value.

9. The method according to claim 4, wherein converting the 3-color source data into 4-color data according to the gain value includes:

generating R(red), G(green), B(blue), and W(white) conversion data using the primary 3-color data, the minimum gray value, and the gain value; and performing gamma-correction on the R, G, B, and W conversion data, and generating the 4-color data.

10. The method according to claim 9, wherein generating R(red), G(green), B(blue), and W(white) conversion data includes:

subtracting the minimum gray value from the primary 3-color data, and generating secondary 3-color data;

multiplying the secondary 3-color data by the gain value, and generating the R, G, and B conversion data; and multiplying the minimum gray value by the gain value, and generating the W conversion data.

11. An apparatus for driving a liquid crystal display (LCD) device comprising:

a liquid crystal panel including a plurality of unit pixels composed of 4-color sub-pixels;

a data driver to transmit a video data signal to individual sub-pixels;

a gate driver to transmit a scan pulse to the sub-pixels;

a data converter to generate a histogram using a gray difference of input 3-color source data, to convert the 3-color source data into 4-color data according to a gain value extracted from the histogram, and to output the 4-color data; and a timing controller to transmit the 4-color data received from the data converter to the data driver and to control the gate driver and the data driver, wherein the data converter includes a first gamma corrector to perform gamma-correction on the 3-color source data and to generate linearized primary 3-color data, a gray detector to detect maximum and minimum gray values for each unit pixel of the linearized primary 3-color data, a histogram generator to generate the histogram using a difference between the maximum and minimum gray values, a gain-value extractor to generate the gain value using the histogram and the gray saturation setup value, wherein the histogram generator includes a first subtracter to subtract the minimum gray value from the maximum gray value and to generate the difference between the maximum and minimum gray values, a histogram calculator to count the number of the unit pixels corresponding to the difference between the maximum and minimum gray values and to calculate a histogram for each gray difference.

12. The apparatus according to claim 11, wherein the data converter is arranged to generate the gain value using the histogram and a gray saturation setup value established by a user.

13. The apparatus according to claim 12, wherein the gray saturation setup value is indicative of the number of pixels to incur gray saturation from among the plurality of unit pixels.

14. The apparatus according to claim 12, wherein the data converter includes:

an RGBW generator to generate R(red), G(green), B(blue), and W(white) conversion data using the linearized primary 3-color data, the minimum gray value, and the gain value; and a second gamma corrector to perform gamma-correction on the R, G, B, and W conversion data received from the RGBW generator and to generate the 4-color data.

15. The apparatus according to claim 14, wherein the histogram generator includes:

a histogram accumulator to accumulate the histogram for each gray difference and to calculate the accumulated histogram for each gray difference.

16. The apparatus according to claim 15, wherein the histogram accumulator is arranged to perform the accumulation in the direction from first histogram having a maximum gray difference to second histogram having a minimum gray difference.

17. The apparatus according to claim 15, wherein the gain value extractor is arranged to recognize a gray loss limit value indicating a specific time at which the accumulated histogram for each gray difference exceeds the gray saturation setup value, to recognize a total number of grays corresponding to the number of bits of the source data, and to generate the gain value using the recognized gray loss limit value and the recognized gray number.

18. The apparatus according to claim 17, wherein the gain-value extractor is arranged to divide the total number of grays by the sum of the specific number of 1 and the gray loss limit.

19. The apparatus according to claim 14, wherein the RGBW generator includes:

a second subtracter to subtract the minimum gray value from the primary 3-color data, and to generate secondary 3-color data; and a multiplier to multiply the secondary 3-color data received from the second subtracter by the gain value to generate the R, G, and B conversion data, and to multiply the minimum gray value by the gain value to generate the W conversion data.

* * * * *